United States Patent [19]

Wright

[11] 3,931,417

[45] Jan. 6, 1976

[54] METHOD OF MANIFOLD COPYING

[75] Inventor: Robert J. Wright, Tranmere, Australia

[73] Assignee: Moore Business Forms Inc., New York, N.Y.

[22] Filed: Jan. 3, 1972

[21] Appl. No.: 215,201

Related U.S. Application Data

[63] Continuation-in-part of Ser. No. 120,763, March 3, 1971, abandoned.

[30] Foreign Application Priority Data

Feb. 26, 1971 Australia ..... 25945/71

[52] U.S. Cl. ..... 427/19; 101/DIG. 13; 427/17; 427/145

[51] Int. Cl.[2] ..... G03G 16/00

[58] Field of Search ..... 117/1.7, 17.5, 11; 427/19, 427/17, 145

[56] References Cited

UNITED STATES PATENTS

| | | | |
|---|---|---|---|
| 3,108,894 | 10/1963 | Stowell | 117/17.5 |
| 3,206,600 | 9/1965 | Gold | 117/1.7 |
| 3,579,330 | 5/1971 | Cunningham et al. | 96/1 |

*Primary Examiner*—Ralph Husack

*Attorney, Agent, or Firm*—Kinzer, Plyer, Dorn & McEachran

[57] ABSTRACT

A method of manifold copying using recording members having a dielectric surface on one side and surface of relatively lower resistivity on the opposite surface, which comprises forming a pack by placing sheet on sheet with the dielectric surfaces facing one way so that each dielectric surface excepting on one outer sheet is in contact with the lower resistivity surface of the next sheet, then placing the pack on a support with the lower resistivity surfaces on each sheet facing the support, then contacting the sheet further removed from the support with pressure imaging means, thereby to form a latent image on each dielectric surface, then separating the sheets of the pack and developing the latent image on each sheet by attracting thereto electroscopic marking particles.

5 Claims, No Drawings

METHOD OF MANIFOLD COPYING

This invention is a continuation in part of our earlier patent application Ser. No. 120,763 of Mar. 3, 1971, now abandoned relating to manifolding and in particular relates to a method whereby duplicate copies of visual information may be produced by pressure printing methods without using a transfer tissue such as a carbon coated tissue or the like.

Pressure transfer printing methods are known in which duplicate copies of visual information are produced simultaneously by the use of carbon coated tissues interleaved between the sheets upon which the information is required to be reproduced, such methods including the well known typewriter and computer printout devices, in which a raised character is used to impress a pressure area on the stack of sheets, whereby such pressure transfers carbon or other colouring material from the tissue or other donor surface to the face of the recording member in contact with the coated side of such tissue. A more recent method of producing such copies is known in which the printing pressure is used to release reacting chemicals contained at the surface of the recording member and the back of the overlying sheet. In other instances the carbon coating or other colouring matter may be contained on the back of the overlying sheet itself.

A disadvantage of such prior art carbon transfer methods is the limited number of legible copies which may be produced simultaneously due to a progressive loss in the edge definition which occurs when the position of the recording member in the stack becomes progressively further removed from the image impressing means. This disadvantage is accompanied by a density loss which is also progressive and in combination these two factors necessitate the production of carbon tissues on which the carbon coating is of higher density than would be necessary to produce acceptable density legible copy when a lesser number of copies were to be produced. It is also apparent that much of the carbon or other coating on the tissue is wasted as only a very small percentage of such tissue is normally subjected to the printing pressure in order to obtain pressure transfer copies on the recording members.

Electrostatic recording methods and means are also known in which an electrostatic charge corresponding to the information to be recorded is impressed by various means on the surface of a recording member, such as is known for instance in the art of signal recording. Electrostatic signal recording means usually employ a stylus or styli which contact the dielectric surface of an electrographic sheet, and to which a voltage impulse may be applied whereby an electrostatic charge is applied patternwise to the dielectric surface of the electrographic recording member, such electrostatic charge pattern being developed by attracting thereto an electroscopic powder which may be dry marking particles or a suspension of such marking particles in an insulating carrier liquid, the insulating properties of the liquid being defined in relation to its volume resistivity and dielectric constant, and it is normally considered that such carrier liquids have a volume resistivity in excess of $10^9$ ohm-cm and dielectric constant less than 3. When such voltage impulses are applied to selected styli or to styli positioned in selected positions by the action of a sensing means scanning the original document the charge pattern which is ultimately developed corresponds to the information contained on the original.

A disadvantage of such electrostatic recording methods lies in their general restriction to the production of single copies only at the one time, and consequently prior art electrostatic recording methods have not been found applicable to manifolding.

It is also known to produce electrostatic images on dielectric surfaces by contacting such surfaces with a relatively conducting member and applying an impact which forces the two surfaces into patterned contact, as taught by Stowell in U.S. Pat. No. 3,108,994. However the Stowell method is not applicable to and nor does it visualise high resolution manifolding. The methods outlined produce mirror images, or images on a single backing member, and the conductive interleaved sheets would be expected to confer the same progressive loss in edge definition as that produced by interleaved carbon tissue if it was attempted to use the Stowell method for manifolding. In addition the removal of the interleaved conducting sheets prior to image development would be a cumbersome operation.

Cunningham et al. in U.S Pat. No. 3,579,330, have proposed a method in which triboelectric separation of materials may be used to provide imaging means. In their method the recording member consists of a sheet of paper or the like having a dielectric surface on one side thereof, which surface is imaged by contact with a triboelectrically different material, such contact being in patterned form. The triboelectrically different surface of U.S. Pat. No. 3,579,330 is referred to as the back surface of the recording member, and the back surfaces of the various recording members are connected together with an electrical conductor contiguous to each during the period of separation. Cunningham considered that the image forming phenomenon was triboelectric in nature and that provided a triboelectric difference existed between the two surfaces in contact a patterned charge could be produced on separation of the two surfaces. He also believed that the latent image was in the form of an electrostatic charge on the dielectric surface of the recording member, and the polarity of this charge depended on the relative positions of the dielectric material and the back surface in the triboelectric series.

We have now found that the several disadvantages of these prior art methods may be overcome in a manner not foreshadowed by the prior art, by utilizing electrostatic charges or dielectric or electric effects or other surface or structural or deformation effects induced in or on the dielectric layer by pressure or contact which effects result in the formation of a latent image which can be rendered visible by the application thereto of electroscopic or electrophoretic toning material. In this instance we have found that manifold copies of information may be produced by pressure imaging means using a recording member which consists of a sheet of paper or the like having coated on one side thereof a dielectric layer such as an alkyd resin or a polyester resin or a polyvinyl butyral resin or the like with a surface resistivity in excess of $10^{12}$ ohms/sq cm, such recording member being further characterised by having a back surface the surface resistivity of which does not exceed $10^8$ ohm/sq cm at 50% relative humidity, such relative surface conductivity being obtained by coating the backing with a low resistivity medium or soaking the backing member itself with a solution of a conductive resin or the like prior to the application of the dielectric layer. We have found that when a stack of such recording members is positioned so that the dielectric surface of each recording member is contacted with the backing of the overlying sheet, the impact of a typewriter key or the like against the surface of the top sheet of the stack produces a latent image on the dielectric surface of each recording member in the stack corresponding to the shape of the impacting surface of the typewriter key or the like. We have also found surprisingly that the impact force necessary to produce such latent images in a manifold set is considerably less than that required when carbon tissue is used for manifold copying, it being possible using our recording member combination to image up to 10 sheets simultaneously on an electric typewriter at the pressure setting normally used to produce one copy only.

While it has been stated in the foregoing that the back surface of each sheet should have a surface resistivity not exceeding $10^8$ ohm/cm$^2$, this is only required in order to produce copies of maximum resolution and intensity in the best manner known to us at present. In order to obtain some understanding of the work function involved in carrying out this invention, we have imaged dielectric surfaces against a variety of backing surfaces, and have found surprisingly that in some instances a dielectric surface may be imaged by being pressed into patterned contact with another dielectric surface of the same composition. A latent image is produced on each surface, and each may be developed in the same sense, that is each latent image develops in a manner indicating that if the latent image is an electrostatic charge, the charge on each surface is of the same polarity. It thus appears that at least in part the latent image is produced by surface deformation or volume compression of the dielectric material in the image areas, such deformation or compression being developed as an apparent electrostatic surface charge by the application of electroscopic marking particles to the deformed dielectric surface. The use of a relatively conducting backing in contact with the dielectric surface during imaging enhances image density obtained on development, however we have found that the triboelectric difference between the two surfaces is not a reliable measure of attainable image density, and does not necessarily have any relation to the polarity of the apparent charge of the latent image. Thus a dielectric layer consisting of a continuous film of polyvinyl butyral resin may be imaged to produce a latent image of apparent negative charge when pressed against chromium, steel, copper, aluminum, polyester film, polyethylene, bond paper and the like. The polyester film was simultaneously imaged and its image area was also apparently negatively charged. Generally enhanced images are produced when the dielectric surface is imaged in contact with another surface from which negative ions or negatively charged molecules can transfer to the dielectric surface under pressure. Alternatively positive ions or positively charged molecules may be ejected from the dielectric layer under pressure and be absorbed by some backing materials and thus removed from the dielectric layer. Thus the formation of the latent image on the dielectric surface is believed to be primarily an electron migration brought about by distortion or compression of the dielectric layer which in selected instances may be enhanced by electron or ionic or molecular migration from the backing in contact with the dielectric surface under pressure. The latent image is not formed triboelectrically and the apparent polarity of the latent image does not appear to be influenced by triboelectric differences which may exist between the dielectric surface and the backing. It will be realised that the previously referred to requirement that the backing should have a surface resistivity not in excess of $10^8$ ohm/sq cm refers to preferred embodiments of the invention, in which coating materials capable of producing the required image enhancement when used as conducting base coatings are generally less than $10^8$ ohm/sq cm surface resistivity when coated on a paper base in a substantially continuous layer. However many conducting materials, such as metal surfaces, are not as effective as the relatively less conductive materials used as back coatings on paper webs or the like. We have found generally that those backing materials which produced the density enhancement previously referred to have been film forming resins, in some instances with additives, with surface resistivities as coated within the range $10^3$ ohm/sq cm - $10^8$ ohm/sq cm at 50% relative humidity.

The following examples will serve further to illustrate the invention, but it should be realised that the examples are intended to be read in the illustrative sense only and not as a restriction to the scope of the invention.

EXAMPLE 1

A manifold paper of 25 grms/sq. meter substance was coated on one side only with a 5 grm/sq. meter coating of vinylbenzyl trimethyl ammonium chloride, and dried. This coating had a surface resistivity of $1 \times 10^6$ ohm/sq. cm. at 50% relative humidity. The opposite side of the sheet was coated with a dielectric layer of a polyvinyl butyral resin, the weight of this coating being 3 grms/sq. meter. The polyvinyl butral resin used contained 18–21% polyvinyl alcohol, 69–71% acetal, and is manufactured and supplied under the Trade Name "Mowital" B30H by Hoechst. The surface resistivity of this coating was slightly in excess of $10^{12}$ ohm/sq. cm.

A manifold set of ten sheets of the so produced recording member was positioned in an electric typewriter, the individual sheets being positioned so that the dielectric surface of each sheet other than the top sheet was in contact with the backing of the overlying sheet. The required information was typed on the dielectric surface of the top sheet using the minimum impact pressure setting of the typewriter. The sheets were then removed from the typewriter and separated. With the exception of the top sheet which had been imaged by the typewriter ribbon, the sheets of the manifold set were each developed in a bath of liquid dispersed electrophotographic toner of the type already described. The actual developer used was of the well known office copier type, polarity controlled to deposit on electrostatic latent images of negative polarity. A clean sharp image was developed on each sheet, the image density being in excess of 1.0 on each sheet, and the information on the tenth copy was clearly readable.

EXAMPLE 2

The dielectric layer of the recording member of Example 1 was replaced with a polyvinyl butyral resin containing a higher proportion of acetal, namely 76–78% produced under the Trade Name "Mowital" B60H by Hoechst.

EXAMPLE 3

The dielectric layer of the recording member of Example 1 was replaced with a short oil alkyd resin, oil type linseed, oil length 40%, acid No. 25–35, viscosity at 25° C T-W Gardner Holt, as produced by Polymer Corporation under the Trade Name "Rhodene" L9.50. The surface resistivity of this material after drying of the coating was $10^{15}$ ohm/sq. cm.

EXAMPLES 4–6

The conductive layer on the backing of each of Examples 1–3 was replaced with a 1 grm/sq. meter impregnation of Dow Q X 2611.7 polyelectrolyte resin. The surface resistivity of the so produced surface coating was $1 \times 10^3$ ohms./sq. cm. at 50% relative humidity.

EXAMPLES 7–9

The conductive layer on the backing of each of Examples 1–3 was replaced with a 2 grm/sq. meter coating comprising 66% by weight ethyl cellulose and 34% by weight calcium chloride. The surface resistivity of the so produced coating was $10^8$ ohm/sq. cm. at 50% relative humidity.

EXAMPLES 10–12

The conductive layer on the backing of each of examples 1–3 was replaced with a 4 grm/sq. meter coating of a vinyl acetate acrylic copolymer resin emulsion, viscosity 30–40 poise, Sp Gr 1.09, particle size 0.1–03 micron, pH 4–5, known as Acropol CA.103, and manufactured under that Trade name by Polymer Corporation.

In each of the examples it was found that the electrostatic latent image was of negative polarity, and in each instance the latent image was of sufficient intensity to be developed with an office copier toner.

It will be realised that coloured toners may be used to develop any or all of the electrostatic latent images produced at the one time if desired, such as the well known liquid dispersed toners used in electrophotograph colour proofing systems and the like.

In addition to materials listed in the examples, we have found vinyl resins, epoxy resins, polyurethane resins, synthetic rubbers and the like to be usable as the dielectric layer on the recording member, provided the chosen materials are film forming and produce a dry film with a surface resistivity in excess of $10^{12}$ ohm/sq. cm. The dielectric layer may be applied by roller or air knife coating or by any other coating method as desired, such coating being applied to a coating weight of the order of 1–10 grms/sq. meter. Generally it will be found advantageous to prepare such coatings as thin as is possible without introducing discontinuities therein, and we have found that the preferred polyvinyl butyral coatings function satisfactorily at a coating weight of 2 grms/sq. meter and no particular advantage is obtained by increasing the coating weight beyond 5 grms/sq. meter.

I claim:

1. The method of manifold copying comprising the following steps:

A. Preparing a multiplicity of thin record sheets to form on each sheet an image-receiving dielectric surface coating having a resistivity of at least $10^{12}$ ohms per square centimeter and a lower resistivity coated reverse surface having a resistivity in the range of $10^3$ to $10^8$ ohms per square centimeter at 50 percent relative humidity, limiting the dielectric surface coating to a coating weight of no more than 10 grams per square meter;

B. forming a manifold pack by stacking a plurality of said record sheets, sheet-on-sheet, with all of the dielectric surfaces facing in one direction so that each dielectric surface in the stack, except the outermost dielectric surface, is in direct contact with the lower resistivity reverse surface of the next adjacent sheet;

C. positioning the manifold pack on a support with the reverse surfaces facing toward the support and the dielectric surfaces facing outwardly from the support;

D. contacting the dielectric surface of the outermost sheet with pressure imaging means in accordance with a given pattern to be reproduced, whereby the dielectric surface of each sheet except the outermost sheet is contacted in pattern form by the lower resistivity surface of the overlying sheet, thereby forming a latent image of said pattern on each dielectric surface;

E. separating the sheets of the manifold pack, the dielectric surface of each sheet retaining a latent image of said pattern; and F. developing the latent image on each sheet, without further charging or imaging, with a developer including marking means capable of deposition in response to said latent image.

2. The method of manifold copying, in accordance with claim 1, in which the record sheets are prepared by coating thin paper stock having a weight of about 25 grams per square meter with a continuous dielectric layer having a density of 1 to 10 grams per square meter.

3. The method of manifold copying, in accordance with claim 2, in which the dielectric layer is formed from a material selected from the group consisting of alkyd resins, epoxy resins, vinyl resins, and synthetic rubbers.

4. The method of manifold copying in accordance with claim 2, in which the preparation of each record sheet includes the step of coating the reverse side of the sheet with a continuous layer of vinylbenzyl trimethyl ammonium chloride.

5. The method of manifold copying in accordance with claim 2, in which the preparation of each record sheet includes the step of coating the reverse side of the sheet with a continuous layer of polyelectrolyte resin.

* * * * *